US009365331B2

(12) United States Patent
Gingras et al.

(10) Patent No.: US 9,365,331 B2
(45) **Date of Patent: *Jun. 14, 2016**

(54) TAMPER EVIDENT CONTAINER

(71) Applicant: Dart Container Corporation, Mason, MI (US)

(72) Inventors: Ryan P. Gingras, Charlotte, MI (US); Dean Garza, Williamston, MI (US)

(73) Assignee: Dart Container Corporation, Mason, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/568,182

(22) Filed: Dec. 12, 2014

(65) Prior Publication Data

US 2015/0096986 A1 Apr. 9, 2015

Related U.S. Application Data

(63) Continuation of application No. 13/954,446, filed on Jul. 30, 2013, now Pat. No. 8,939,307, which is a continuation of application No. 13/194,399, filed on Jul. 29, 2011, now Pat. No. 8,608,008.

(60) Provisional application No. 61/377,317, filed on Aug. 26, 2010.

(51) Int. Cl.
*B65D 43/02* (2006.01)
*B65D 43/16* (2006.01)

(52) U.S. Cl.
CPC ..... *B65D 43/0235* (2013.01); *B65D 43/0254* (2013.01); *B65D 43/16* (2013.01);

(Continued)

(58) Field of Classification Search
CPC ..... B65D 43/0235; B65D 43/16; B65D 43/0254; B65D 43/0237; B65D 2543/00481; B65F 1/16; B65F 1/1646; B21K 13/02
USPC ..... 206/1.5; 220/270, 791, 266, 810, 793, 220/315; 16/222
See application file for complete search history.

(56) References Cited

U.S. PATENT DOCUMENTS 2,915,214 A 12/1959 Frankel
3,674,295 A 7/1972 Padovani (Continued)

FOREIGN PATENT DOCUMENTS

AU 200502314 12/2005
BE 1017894 A6 10/2009

(Continued)

OTHER PUBLICATIONS

British Search Report for GB1113170.3, Mar. 23, 2012.

*Primary Examiner* — Steven A. Reynolds
(74) *Attorney, Agent, or Firm* — McGarry Bair PC

(57) ABSTRACT

A tamper evident and resistant container includes a tray, a cover and a hinge extending from the cover and tray defining a hinge axis about which the tray and cover relatively rotate between a closed position and an opened position. The container further includes a first tab provided on one of the cover or the tray and a second tab provided on the other of the cover or the tray. When the cover is in the closed position, the first and second tabs are spaced relative to each other such that a user may grasp the first tab with one hand and the second tab with another hand and relatively pull the first tab and the second tab away from each other to tear the hinge and separate the cover from the tray.

16 Claims, 16 Drawing Sheets

(52) U.S. Cl.
CPC ..... *B65D2543/0062* (2013.01); *B65D 2543/00101* (2013.01); *B65D 2543/00296* (2013.01); *B65D 2543/00324* (2013.01); *B65D 2543/00509* (2013.01); *B65D 2543/00546* (2013.01); *B65D 2543/00685* (2013.01); *B65D 2543/00731* (2013.01); *B65D 2543/00796* (2013.01); *B65D 2543/00842* (2013.01); *B65D 2543/00907* (2013.01)

(56) References Cited

U.S. PATENT DOCUMENTS

| | | | | |
|---|---|---|---|---|
| D225,050 | S | | 11/1972 | Cannell |
| 3,794,090 | A | | 2/1974 | Commisso |
| 3,902,621 | A | | 9/1975 | Hidding |
| 4,300,700 | A | | 11/1981 | Chang |
| 4,362,252 | A | | 12/1982 | Graff |
| 4,434,907 | A | | 3/1984 | Ingemann |
| 4,576,330 | A | | 3/1986 | Schepp |
| 4,742,935 | A | | 5/1988 | Schellenberg |
| 4,747,510 | A | | 5/1988 | Mack |
| RE32,739 | E | | 8/1988 | Terauds |
| 4,804,092 | A | | 2/1989 | Jones |
| 5,038,937 | A | | 8/1991 | DiSea, Jr. |
| 5,046,659 | A | | 9/1991 | Warburton |
| 5,163,575 | A | | 11/1992 | Luch et al. |
| 5,169,014 | A | | 12/1992 | Hexamer |
| 5,322,178 | A | * | 6/1994 | Foos ..... 220/326 |
| 5,405,009 | A | | 4/1995 | Hackenbracht |
| D360,808 | S | | 8/1995 | Meier et al. |
| 5,507,406 | A | | 4/1996 | Urciuoli et al. |
| 5,584,408 | A | * | 12/1996 | Orkisz ..... 220/4.23 |
| 5,699,913 | A | | 12/1997 | Richardson |
| 5,897,011 | A | * | 4/1999 | Brilliant et al. ..... 220/4.23 |
| 5,979,687 | A | * | 11/1999 | Hayes et al. ..... 220/4.23 |
| 5,984,130 | A | | 11/1999 | Hayes et al. |
| 6,572,909 | B1 | | 6/2003 | Bagwell et al. |
| D484,749 | S | | 1/2004 | Garraway |
| 6,918,506 | B2 | | 7/2005 | Ramirez et al. |
| 7,073,680 | B2 | * | 7/2006 | Boback et al. ..... 220/266 |
| 7,118,003 | B2 | | 10/2006 | Sellari et al. |
| 7,284,673 | B2 | | 10/2007 | Habeger et al. |
| D556,569 | S | | 12/2007 | Stein et al. |
| D569,243 | S | | 5/2008 | Kidd et al. |
| 7,434,777 | B2 | * | 10/2008 | Swannell et al. ..... 248/346.02 |
| D593,369 | S | | 6/2009 | Green et al. |
| 7,568,589 | B2 | | 8/2009 | Vovan |
| D601,013 | S | | 9/2009 | Petitjean |
| 7,597,206 | B2 | | 10/2009 | Atkins et al. |
| D605,936 | S | | 12/2009 | Durdon et al. |
| 7,631,776 | B2 | | 12/2009 | Vovan et al. |
| 7,712,626 | B2 | | 5/2010 | Vovan |
| 7,992,743 | B2 | | 8/2011 | Vovan |
| D646,563 | S | * | 10/2011 | Bontrager et al. ..... D9/425 |
| 8,028,851 | B2 | | 10/2011 | Vovan et al. |
| 8,091,731 | B2 | * | 1/2012 | Kidd et al. ..... 220/788 |
| 8,608,008 | B2 | | 12/2013 | Gingras et al. |
| 8,757,416 | B2 | | 6/2014 | Golota et al. |
| 2005/0161455 | A1 | | 7/2005 | Studee |
| 2006/0278652 | A1 | | 12/2006 | Vovan et al. |
| 2006/0289541 | A1 | | 12/2006 | Boback et al. |
| 2006/0289549 | A1 | | 12/2006 | Vovan |
| 2007/0012710 | A1 | | 1/2007 | Vovan |
| 2007/0045317 | A1 | | 3/2007 | Rosender et al. |
| 2007/0062949 | A1 | | 3/2007 | Bordner |
| 2008/0087669 | A2 | | 4/2008 | Boback et al. |
| 2008/0308557 | A1 | | 12/2008 | Kyle et al. |
| 2009/0090712 | A1 | | 4/2009 | Vovan |
| 2009/0120937 | A1 | | 5/2009 | Vovan |
| 2009/0120942 | A1 | | 5/2009 | Vovan |
| 2009/0206082 | A1 | | 8/2009 | Vovan |
| 2009/0223619 | A1 | | 9/2009 | Vovan |
| 2010/0051620 | A1 | | 3/2010 | Parikh et al. |
| 2010/0072217 | A1 | | 3/2010 | Parikh et al. |
| 2010/0084401 | A1 | | 4/2010 | Golota et al. |
| 2010/0102074 | A1 | | 4/2010 | Parikh et al. |
| 2014/0138383 | A1 | | 5/2014 | Lisowy et al. |
| 2015/0266611 | A1 | | 9/2015 | Dow et al. |

FOREIGN PATENT DOCUMENTS

| | | | |
|---|---|---|---|
| DE | 7816353 | | 11/1978 |
| EP | 1336569 | A2 | 8/2003 |
| EP | 2030908 | A1 | 3/2009 |
| EP | 2210819 | A1 | 7/2010 |
| FR | 2494175 | A1 | 5/1982 |
| FR | 2622535 | A1 | 5/1989 |
| FR | 2779126 | A1 | 12/1999 |
| FR | 2903970 | A1 | 1/2008 |
| FR | 2907102 | A1 | 4/2008 |
| GB | 2195318 | A | 4/1988 |
| GB | 2219284 | A | 12/1989 |
| GB | 2227481 | A | 8/1990 |
| GB | 2234741 | A | 2/1991 |
| GB | 2278838 | A | 12/1994 |
| GB | 2306160 | A | 4/1997 |
| GB | 2412651 | A | 10/2005 |
| WO | 9525675 | A1 | 9/1995 |

* cited by examiner

TAMPER EVIDENT CONTAINER

CROSS REFERENCE TO RELATED APPLICATIONS

The present application is a continuation of U.S. patent application Ser. No. 13/954,446, filed Jul. 30, 2013, now U.S. Pat. No. 8,939,307, issued Jan. 27, 2015, which is a continuation of U.S. Pat. No. 8,608,008, issued Dec. 17, 2013, which claims the benefit of U.S. Provisional Patent Application No. 61/377,317, filed Aug. 26, 2010, all of which are incorporated herein by reference in their entirety.

BACKGROUND

Disposable containers for packaging and storing edible goods are often provided with tamper resistant and tamper evident features to prevent unauthorized access to the container and to indicate to a consumer when the container has previously been opened. That the consumer still finds it desirable to have the tamper evident and resistant features in combination with a resealable container increases the complexity of the container, which may make it more difficult and time consuming to open.

BRIEF DESCRIPTION

According to one embodiment, the invention relates to a container having tamper evident and resistant features which includes a tray, a cover and a hinge extending from the cover and tray defining a hinge axis about which the tray and cover relatively rotate between a closed position and an opened position. The container further includes a first tab provided on one of the cover or the tray and a second tab provided on the other of the cover or the tray. When the cover is in the closed position, the first and second tabs are spaced relative to each other such that a user may grasp the first tab with one hand and the second tab with another hand and relatively pull the first tab and the second tab away from each other to tear the hinge and separate the cover from the tray.

DESCRIPTION OF AN EMBODIMENT OF THE INVENTION

Figure 1:
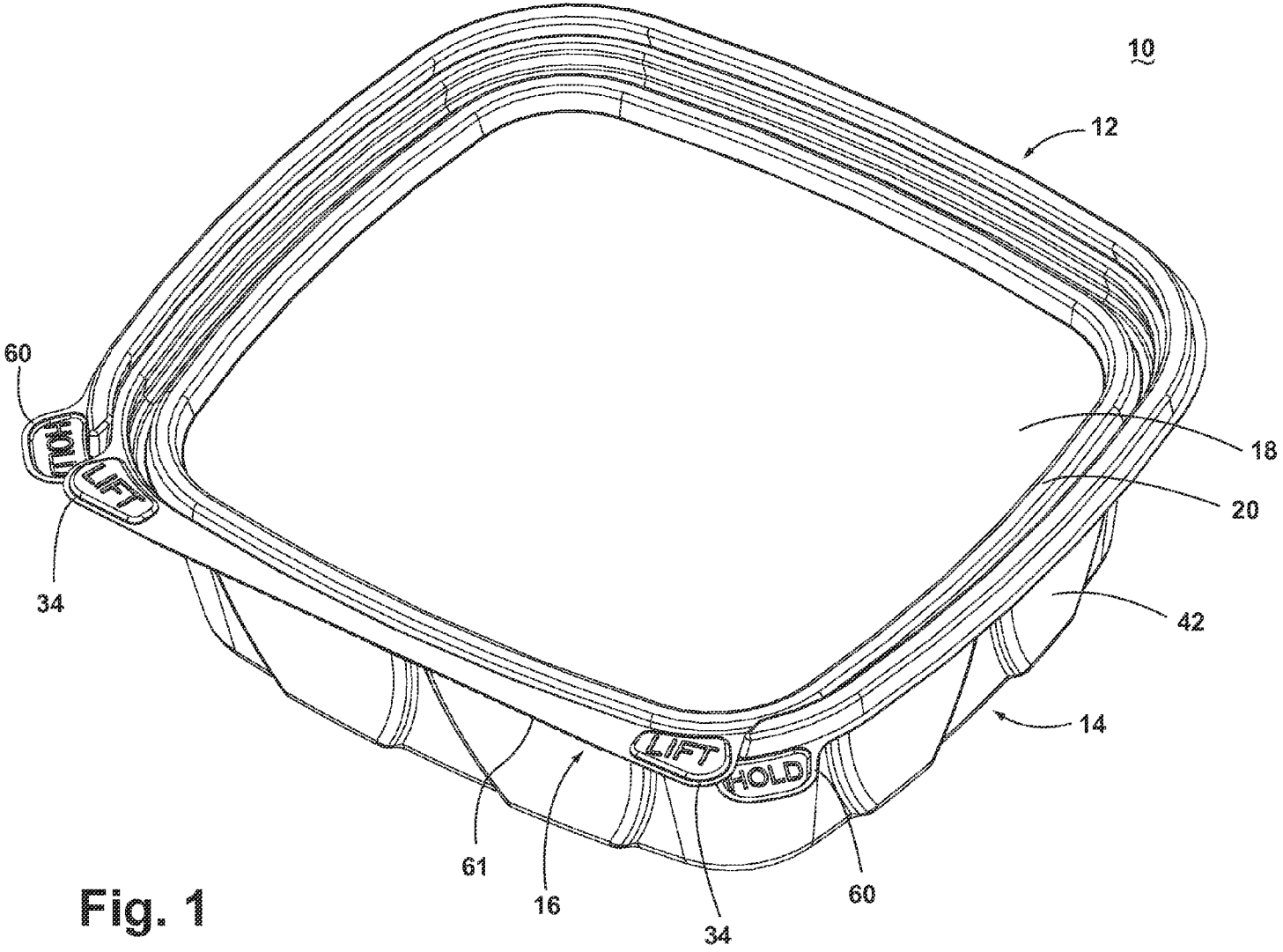
FIG. 1 is a perspective view of a container having a cover hingedly mounted to a tray in a closed position according to a first embodiment of the invention.

FIG. 1 illustrates a container 10 comprising a cover 12 and a tray 14, which are connected by a hinge 16. The cover 12, tray 14 and hinge 16 are preferably integrally formed from a single piece of material in a well known thermoforming process. Non-limiting examples of suitable materials for the container 10 include oriented polystyrene, polypropylene and polyethylene terephthalate. All or a portion of the container 10 can be formed so as to be translucent, transparent, opaque or a combination thereof.

Figure 2:
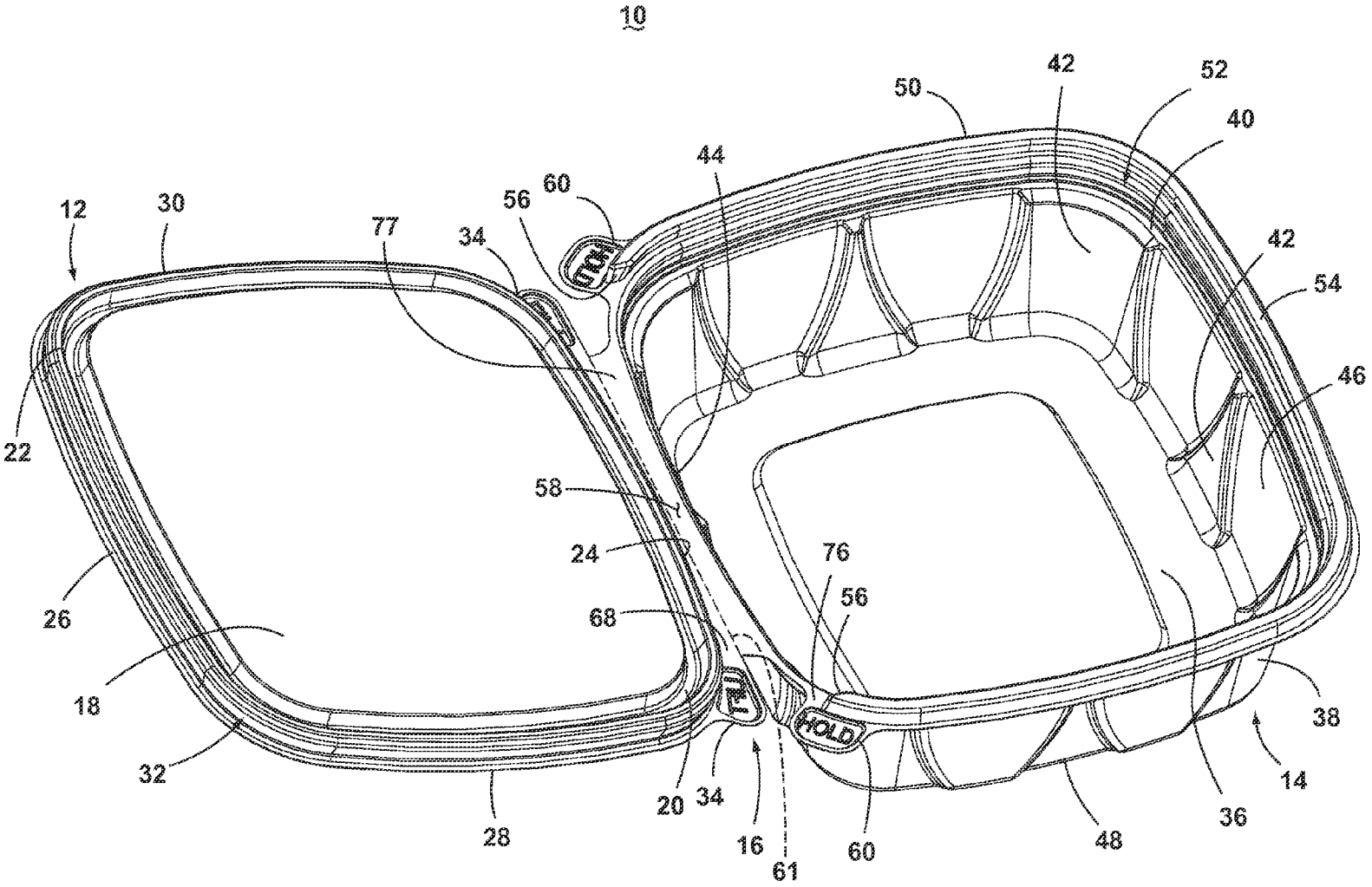
FIG. 2 is a perspective view of a container having a cover hingedly mounted to a tray in an open position according to the first embodiment of the invention.
Figure 3:
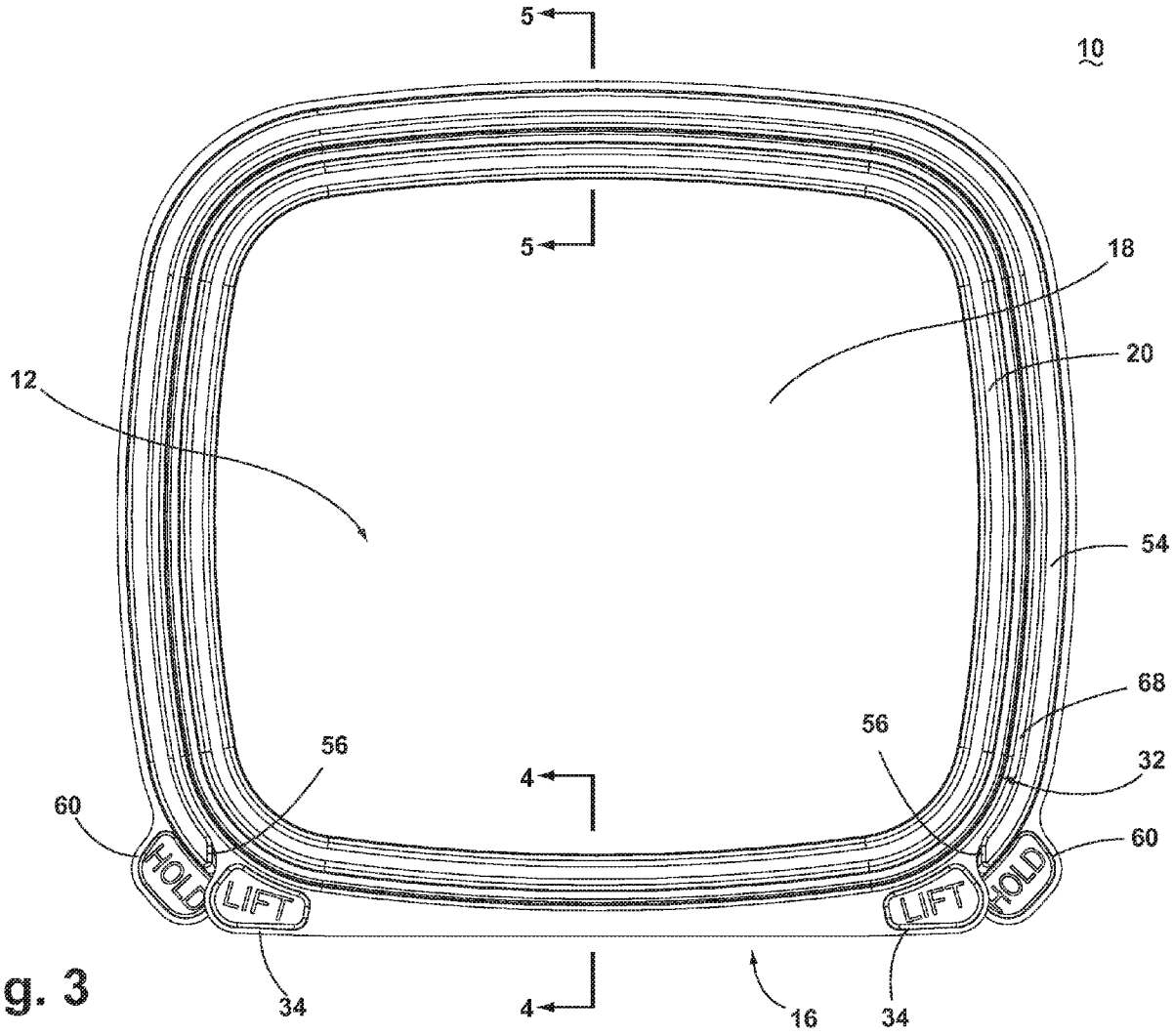
FIG. 3 is a top view of a container having a cover hingedly mounted to a tray in a closed position according to the first embodiment of the invention.

Referring now to FIGS. 2 and 3, the cover 12 includes a top defining a plane. References to above/below the plane are made with respect to the cover 12 in the closed position. A circumferential rib 20, which is a specific example of a type of blocking wall, projects upwardly from the top 18, with a peripheral cover flange 22 extending from the circumferential rib 20. The circumferential rib 20 extends around the perimeter of the top 18 and can provide additional strength and support to the top 18. The circumferential rib 20 can extend around the entire perimeter of the top 18, as illustrated, or the circumferential rib 20 can extend only along the sides of the top 18 not adjacent the hinge 16. A pair of cover tabs 34 extend from a skirt 32 adjacent the hinge 16.

While the cover 12 has a generally rectangular shape and can be thought of as comprising opposing front and rear sides 24, 26 and opposing lateral sides 28, 30, the container may have a variety of different shapes, including non-rectilinear shapes, such as circles, ovals, hexagons, etc.

The tray 14 comprises a bottom 36 from which extends a peripheral sidewall 38 which terminates in a peripheral tray flange 40. A plurality of alternating inwardly and outwardly projecting support panels 42 are provided in the peripheral sidewall 38 for strengthening the tray 14. The peripheral sidewall 38 defines a generally rectangular shape comprising opposing front and rear sides 44, 46 and opposing lateral sides 48, 50, with the hinge 16 located adjacent the front side 44. Like the cover 12, the tray 14 can have a variety of shapes.

An upwardly projecting rib 52 forming a tray seal structure extends from the peripheral tray flange 40 around the perimeter of the tray 14. A blocking shield 54 extends from the rib 52 around a portion of the perimeter of the tray 14 corresponding to the rear side 46 and opposing lateral sides 48, 50.

Opposing ends 56 of the blocking shield 54 define a gap 58 in the blocking shield 54 along the front side 44 of the tray 14. A pair of tray tabs 60 extend from the rib 52 adjacent the blocking shield 54, but spaced from the hinge 16.

The hinge 16 is located adjacent the front side 24 of the cover 12. The hinge 16 can comprise a weakened line 61 in the form of a score line or a series of perforations to weaken the hinge 16 such that the hinge 16 can be torn along the weakened line 61 to separate the cover 12 from the tray 14. Alternatively, the weakened line 61 can be formed from a series of alternating rounded crests and troughs of narrowed thickness. The weakened line 61 forms a hinge line or hinge axis about which the cover 12 and tray 14 relatively rotate to move the container 10 between the opened and closed positions.

As illustrated in FIG. 3, when the container 10 is in the closed position, neither the cover tabs 34 nor the tray tabs 60 extend beyond the hinge line such that the cover and tray tabs 34 and 60, respectively, are located radially interiorly of the hinge line relative to a central axis extending through the cover 12 and the tray 14 when the cover 12 is in the closed position. The cover tabs 34 are located adjacent the hinge line. The tray tabs 60 are spaced laterally from both the hinge line and the cover tabs 34. The cover tabs 34 and tray tabs 60 can be labeled with the words "LIFT" and "HOLD", respectively, as illustrated, to guide the consumer in opening the container. It is also within the scope of the invention for the cover tabs 34 and tray tabs 60 to be labeled with different words or to not be labeled at all.

Figure 4:
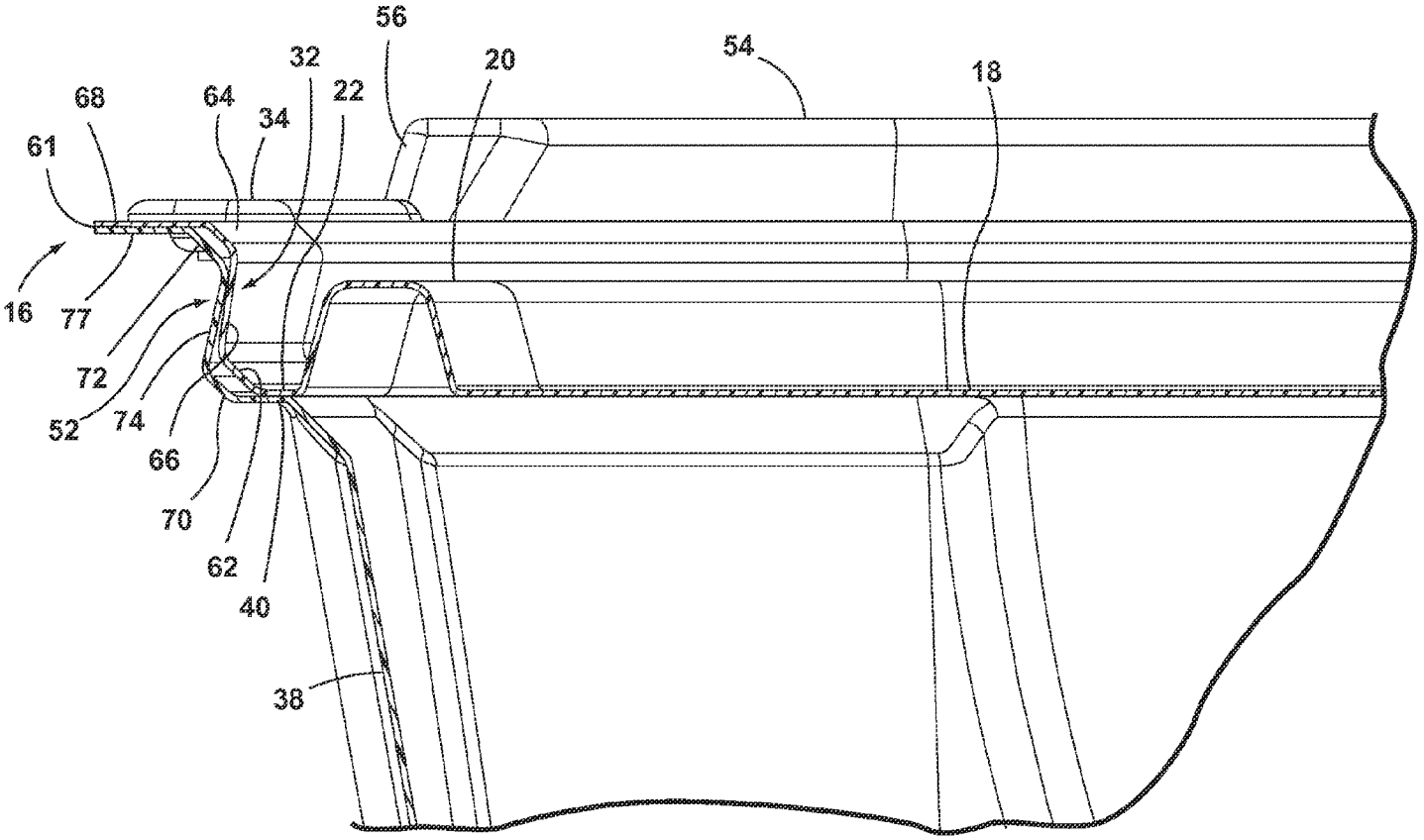
FIG. 4 is a partial cross-section of the container of FIG. 3 taken along the line 4-4.

Referring now to FIG. 4, the skirt 32 and rib 52 adjacent the hinge 16 are now described. The skirt 32 extends upwardly from the peripheral cover flange 22 and comprises a first outwardly angled cover leg 62 connected to a second outwardly angled cover leg 64 by an inwardly angled cover leg 66. The second outwardly angled cover leg 64 is connected with a peripheral cover lip 68 which is connected to the hinge 16 along a portion of the front side 24 of the cover 12.

As can best be seen in FIGS. 2 and 3, the peripheral cover lip 68 extends outwardly from the cover 12 into the gap 58 defined by the opposing ends 56 of the blocking shield 54 to meet the hinge 16. The cover tabs 34 are formed in the portion of the peripheral cover lip 68 extending between the opposing ends 56 adjacent the hinge 16.

Referring back to FIG. 4, the rib 52 extends upwardly from the peripheral tray flange 40 and comprises a first outwardly angled tray leg 70 connected to a second outwardly angled tray leg 72 by an inwardly angled tray leg 74. The second outwardly angled tray leg 72 is connected with a peripheral tray lip 76 which is connected with the hinge 16 along a portion of the front side 44 of the tray 14 by a lip extension 77.

As can best be seen in FIGS. 2 and 3, the blocking shield 54 is formed in the peripheral tray lip 76 along the rear side 46 and opposing lateral sides 48, 50 of the tray 14. The lip extension 77 extends outwardly from the peripheral tray lip 76 in the gap 58 defined by opposing ends 56 of the blocking shield 54 to meet the hinge 16. The tray tabs 60 are formed in the peripheral tray lip 76 and are generally located adjacent the opposing ends 56 of the blocking shield 54 near the gap 58, but laterally spaced from the hinge 16.

Referring to FIG. 4, in the closed position, the peripheral cover flange 22 and the peripheral tray flange 40 abut one another, as do the peripheral cover lip 68 and the peripheral tray lip 76. The inwardly angled tray leg 74 is inclined towards a center of the container 10 such that in the closed position the inwardly angled tray leg 74 presses against the inwardly angled cover leg 66 providing an interference fit between the cover 12 and the tray 14. The interference fit between the inwardly angled cover and tray legs 66, 74, respectively, provides a peripheral seal between the cover 12 and the tray 14 and facilitates maintaining the inwardly angled cover leg 66 and inwardly angled tray leg 74 in the closed position.

Figure 5:
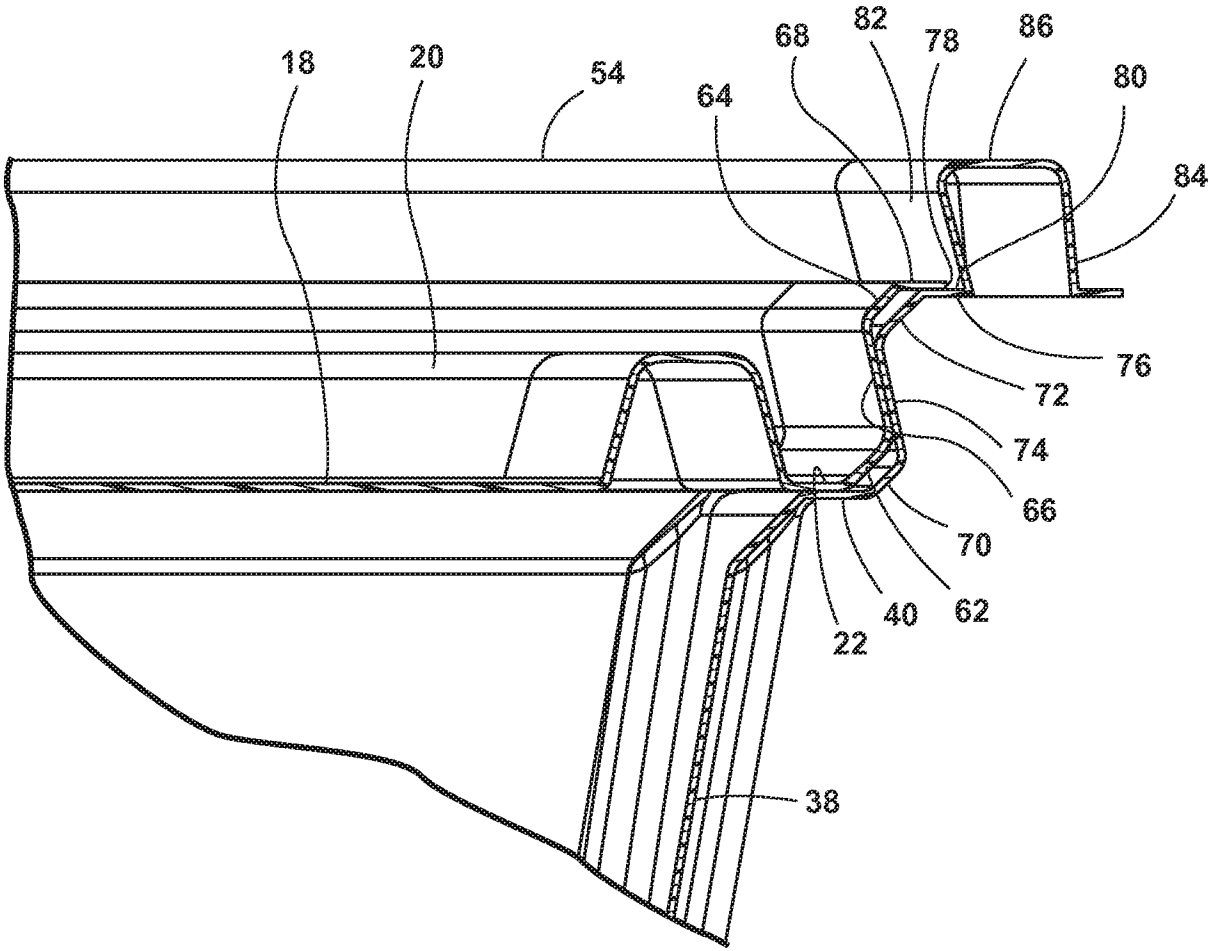
FIG. 5 is a partial cross-section of the container of FIG. 3 taken along the line 5-5.

Referring now to FIG. 5, on the rear side 46 and lateral sides 50 and 48 along which the blocking shield 54 is located, an outer distal end 78 of the peripheral cover lip 68 is received and retained by an undercut 80 in the blocking shield 54. The blocking shield 54 comprises an angled inner wall 82 extending from the peripheral tray lip 76 coupled with an outer vertical wall 84 by a horizontal wall 86. When the distal end 78 of the peripheral cover lip 68 is received by the undercut 80, the angled inner wall 82 prevents access to the peripheral cover lip 68 and thus prevents a consumer from opening the container along the rear side 46 and lateral sides 48, 50 of the tray 14 without destroying or damaging the blocking shield 54.

Figure 6:
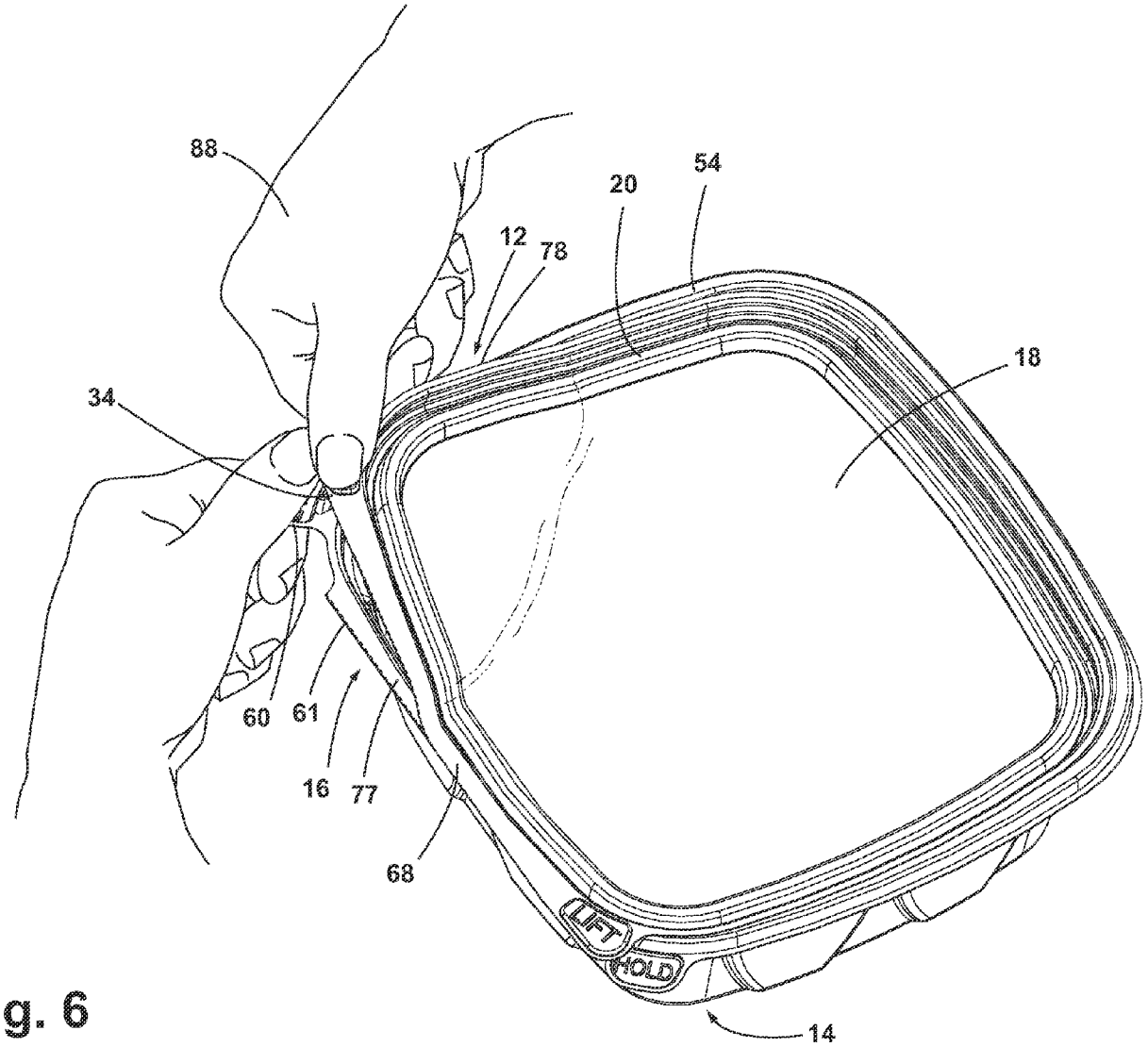
FIG. 6 illustrates a consumer opening a container having a cover hingedly mounted to a tray according to a second embodiment of the invention.

Referring now to FIG. 6, to open the container 10, a consumer 88 separates the cover 12 from the tray 14 along the hinge 16 because the blocking shield 54 prevents access to the peripheral cover lip 68. To separate the cover 12 from the tray 14, the consumer 88 grasps the cover tab 34 and the tray tab 60 and pulls on the cover tab 34 to separate the cover 12 from the tray 14. As the consumer 88 pulls on the cover tab 34, the distal end 78 of the peripheral cover lip 68 is unseated from its location within the undercut 80 and the hinge 16 tears along the weakened line 61. The blocking shield 54 prevents access to the peripheral cover lip 68 and thus prevents access to the contents of the container 10 without using the cover tabs 34 and tearing the hinge 16 along the weakened line 61. In this manner, the blocking shield 54 provides the container 10 with a tamper resistant feature in that the container 10 cannot be opened except in a manner which provides evidence that the container 10 has been opened.

The location of the circumferential rib 20 adjacent the inwardly angled cover leg 66 provides the container 10 with additional tamper resistance by limiting the space available for a consumer to attempt to grasp the peripheral cover lip 68. In this manner, the circumferential rib 20 can provide the container 10 with an additional blocking shield to prevent a consumer from grasping the peripheral cover lip 68 in an attempt to open the container 10 without the use of the cover tabs 34.

Figure 7:
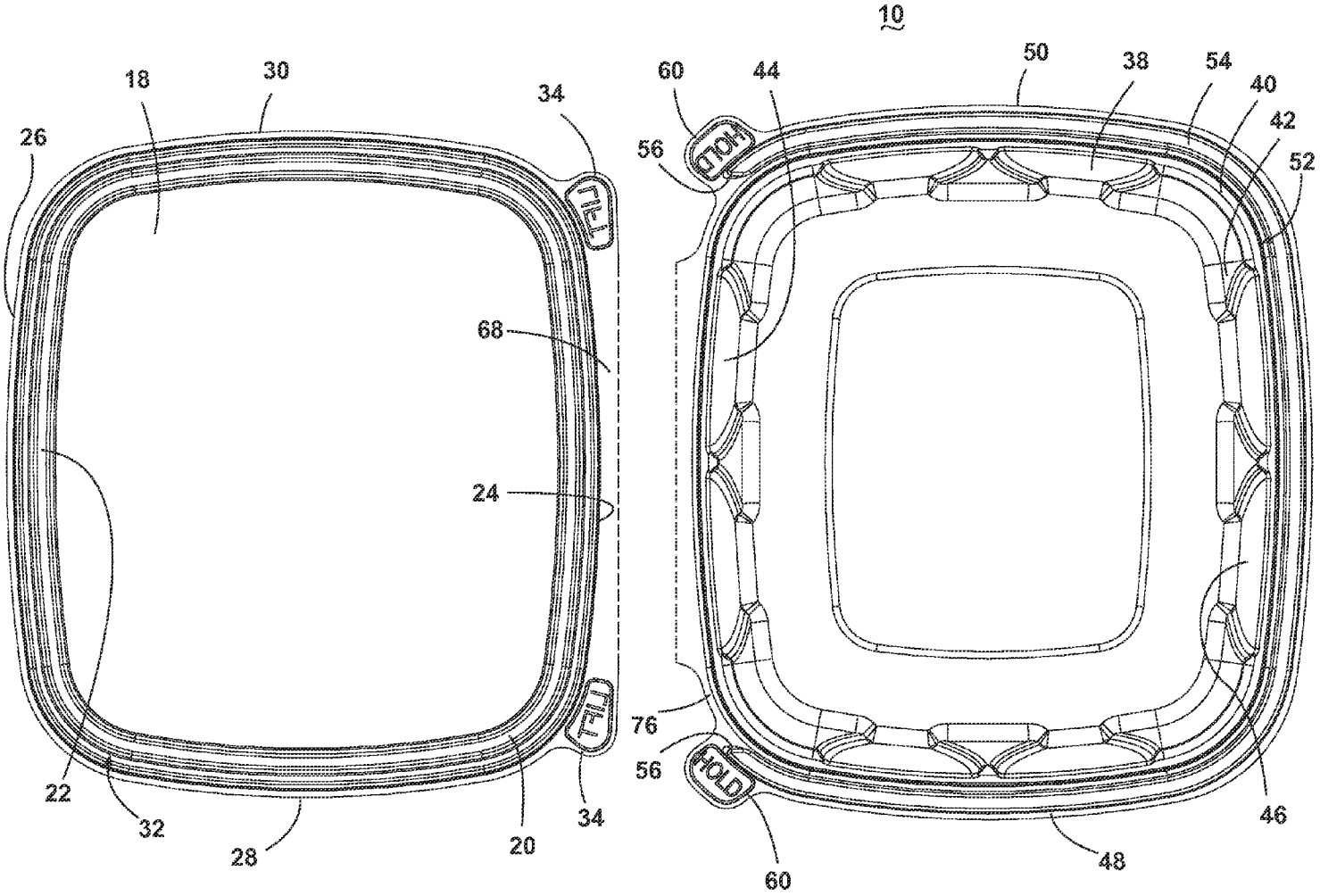
FIG. 7 illustrates the container of FIG. 6 after it has been opened and the cover separated from the tray according to the second embodiment of the invention.

Once the container 10 is completely opened, the cover 12 and tray 14 are separated along the hinge 16, as illustrated in FIG. 7. The tearing of the hinge 16 provides evidence to a consumer that the container 10 has been opened or that an attempt to open the container 10 has been made. Once the cover 12 has been separated from the tray 14 to gain access to the contents of the container 10, the cover 12 can be replaced on the tray 14 and held in place by the cover and tray seal structures formed by the cover skirt 32 and tray rib 52, respectively. The torn hinge 16 serves as a visual indicator that the container 10 has been opened and provides the container 10 with a tamper evident feature.

The hinge 16 does not extend along the full length of the front sides 24 and 44 of the cover 12 and tray 14, respectively, but rather extends only along a portion of the front sides 24, 44 between the cover tabs 34. The tray tabs 60 are spaced laterally from both the hinge 16 and cover tabs 34. The length of the hinge 16 and the spacing of the tray tabs 60 from the hinge 16 and cover tabs 34 provides room underneath the cover tabs 34 for the consumer 88 to grasp the cover tab 34, thus making it easier for the consumer 88 to adequately grasp the cover tabs 34 and provide enough force to overcome the peripheral seal between the cover 12 and the tray 14 to separate the cover 12 and tray 14.

While the container 10 is illustrated as having a pair of cover and tray tabs 34 and 60, respectively, on each side of the hinge 16, it is also within the scope of the invention for the container 10 to have a single cover tab 34 and a single tray tab 60.

FIGS. 8-11 illustrate another embodiment of the invention comprising a container 110, which is similar to the first container 10 except for the manner in which a hinge 116 is formed, the absence of a blocking shield and the addition of a plurality of bar locks 190. Therefore, elements in the container 110 similar to those of the container 10 will be numbered with the prefix 100.

Figure 8:
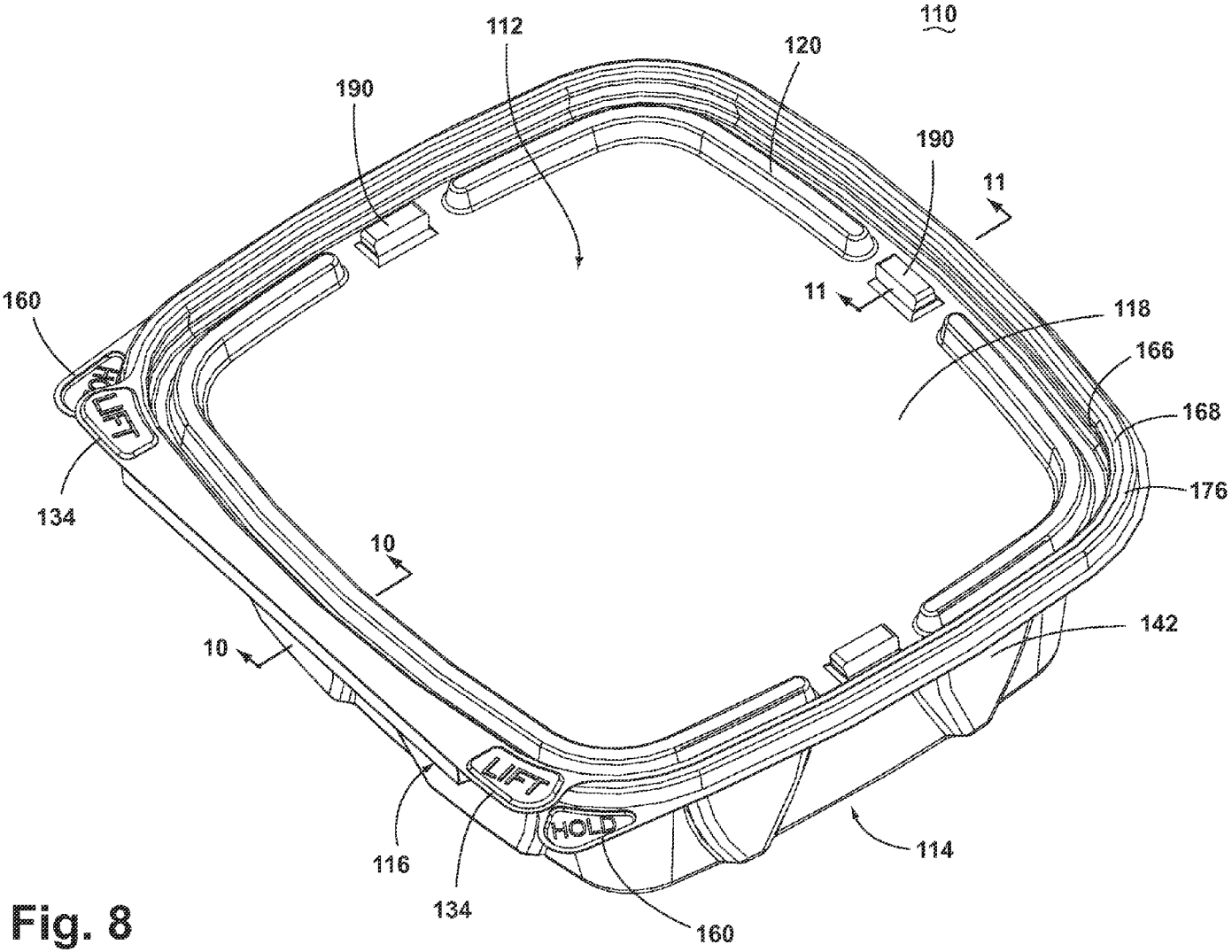
FIG. 8 is a perspective view of a container having a cover hingedly mounted to a tray in a closed position according to a third embodiment of the invention.
Figure 9:
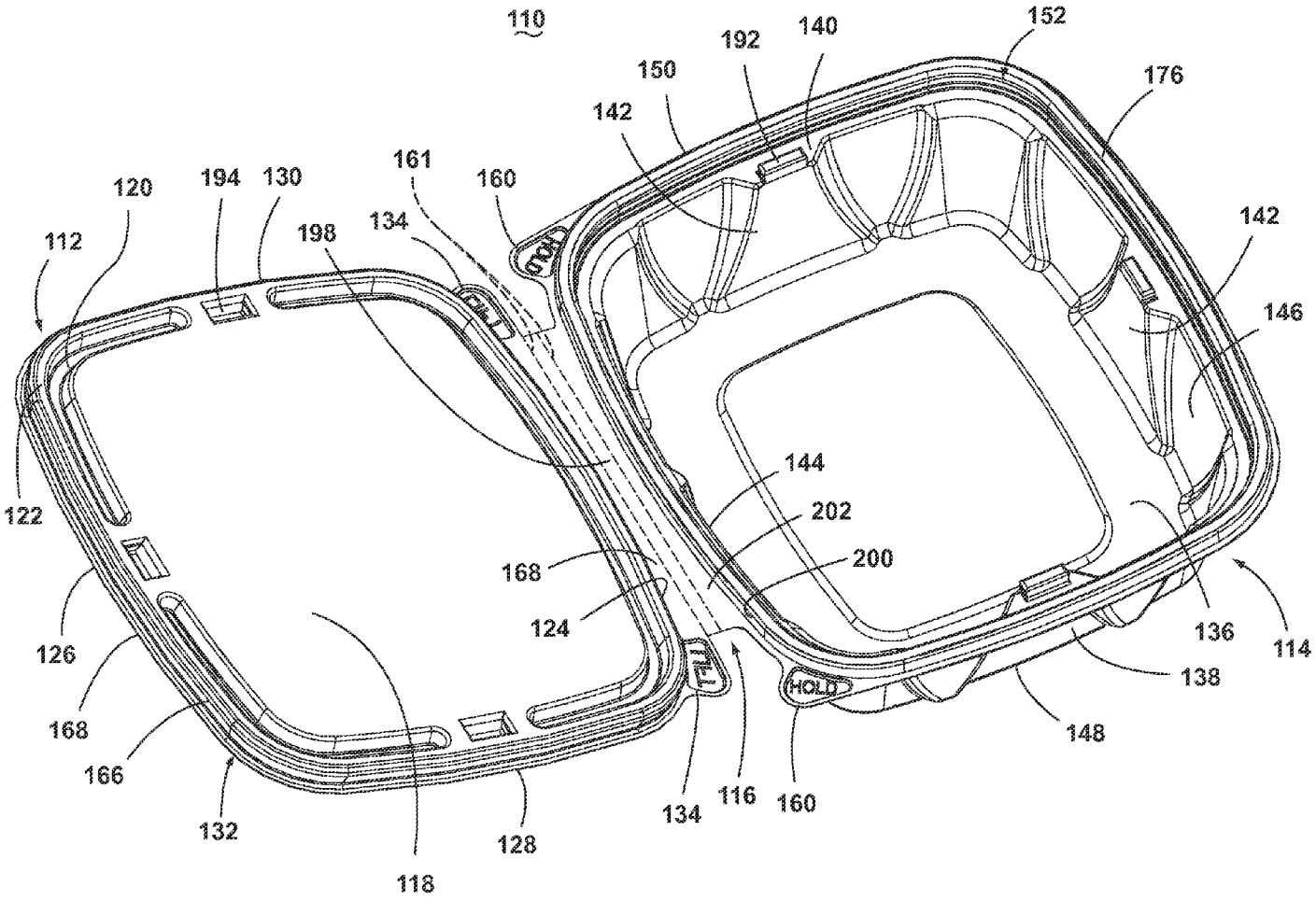
FIG. 9 is a perspective view of a container having a cover hingedly mounted to a tray in an open position according to the third embodiment of the invention.

Referring now to FIGS. 8 and 9, the cover 112 includes the top 118 from which extends the circumferential projection 120. The circumferential projection 120 extends around the perimeter of the top 118 except for where the circumferential projection 120 is interrupted by a bar lock 190. As can best be seen in FIG. 9, a male portion 192 of the bar lock 190 can be formed in an extension of the peripheral tray flange 140 which projects inward toward a center of the tray 114 and is connected with an upper portion of a corresponding inwardly projecting support panel 142. The cover 112 is provided with a female portion 194 of the bar lock 190 corresponding to each of the male portions 192. It is also within the scope of the invention for the location of the male and female portions 192, 194 on the tray 114 and cover 112 to be reversed.

As illustrated in FIG. 9, the male portion 192 can be formed in the peripheral tray flange 140 corresponding to a generally centrally located support panel 142 formed in each of the rear side 146 and lateral sides 148, 150 of the tray 114. It is also within the scope of the invention for the container 110 to include additional or fewer bar locks 190. The bar locks 190 facilitate maintaining the container 110 in the closed position, as is well known in the art. The particular type of bar lock is not germane to the invention and it is within the scope of the invention for any number of bar locks having any suitable size or shape to be used with the container 110.

Figure 10:
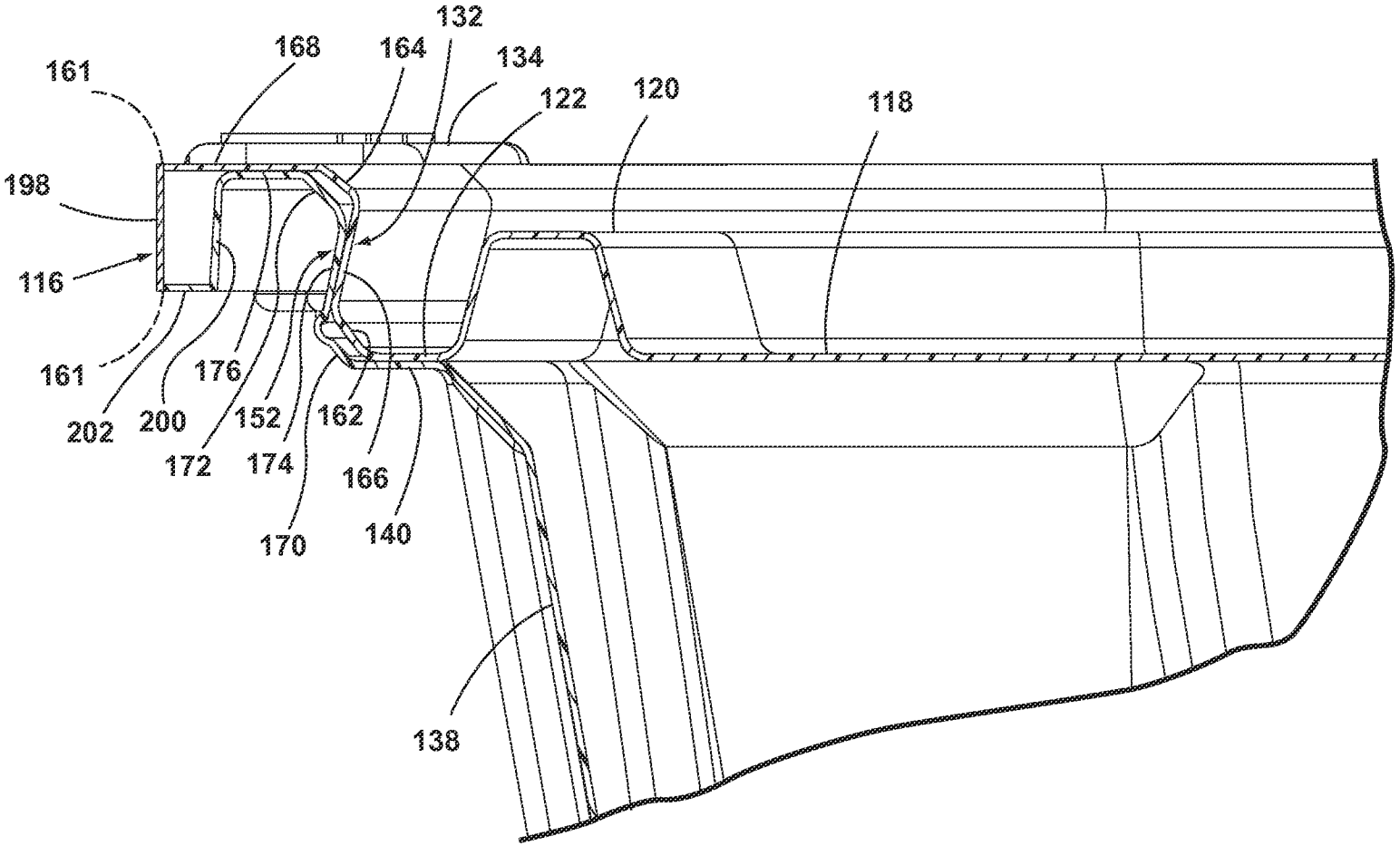
FIG. 10 is a partial cross-section of the container of FIG. 8 taken along the line 10-10.

Referring now to FIGS. 9 and 10, along the front sides 124, 144 the cover 112 and tray 114 are connected by the hinge 116. The hinge 116 comprises a vertical hinge wall 198 coupled at an upper portion thereof with the peripheral cover lip 168 of the skirt 132 by a weakened line 161. The peripheral tray lip 176 is connected with the vertical hinge wall 198 at a lower portion thereof by a downwardly extending skirt 200 and an outwardly extending skirt flange 202. The hinge wall 198 can be connected with both the cover 112 and the tray 114 at upper and lower portions thereof by a pair of weakened lines 161. In one example, the hinge wall 198 can be connected to both the cover 112 and tray 114 by a pair of perforation lines. In another example, the hinge wall 198 can be connected with one of the cover 112 and tray 114 by a perforation line and the other of the cover 112 and tray 114 by a coin line. In yet another example, at least one of the pair of weakened lines 161 can be formed from a series of alternating rounded crests and troughs of narrowed thickness.

Referring back to FIGS. 8 and 9, the cover tabs 134 can be formed in the peripheral cover lip 168 of the skirt 132 adjacent the hinge 116. The tray tabs 160 can be formed in the skirt flange 202 extending from the rib 152, laterally spaced from both the hinge 116 and the cover tabs 134. In the closed position illustrated in FIG. 8, neither the cover tabs 134 nor the tray tabs 160 extend beyond the hinge line. While the container 110 is illustrated as having a hinge 116, it is also within the scope of the invention for the container 110 to not have a hinge.

Figure 11:
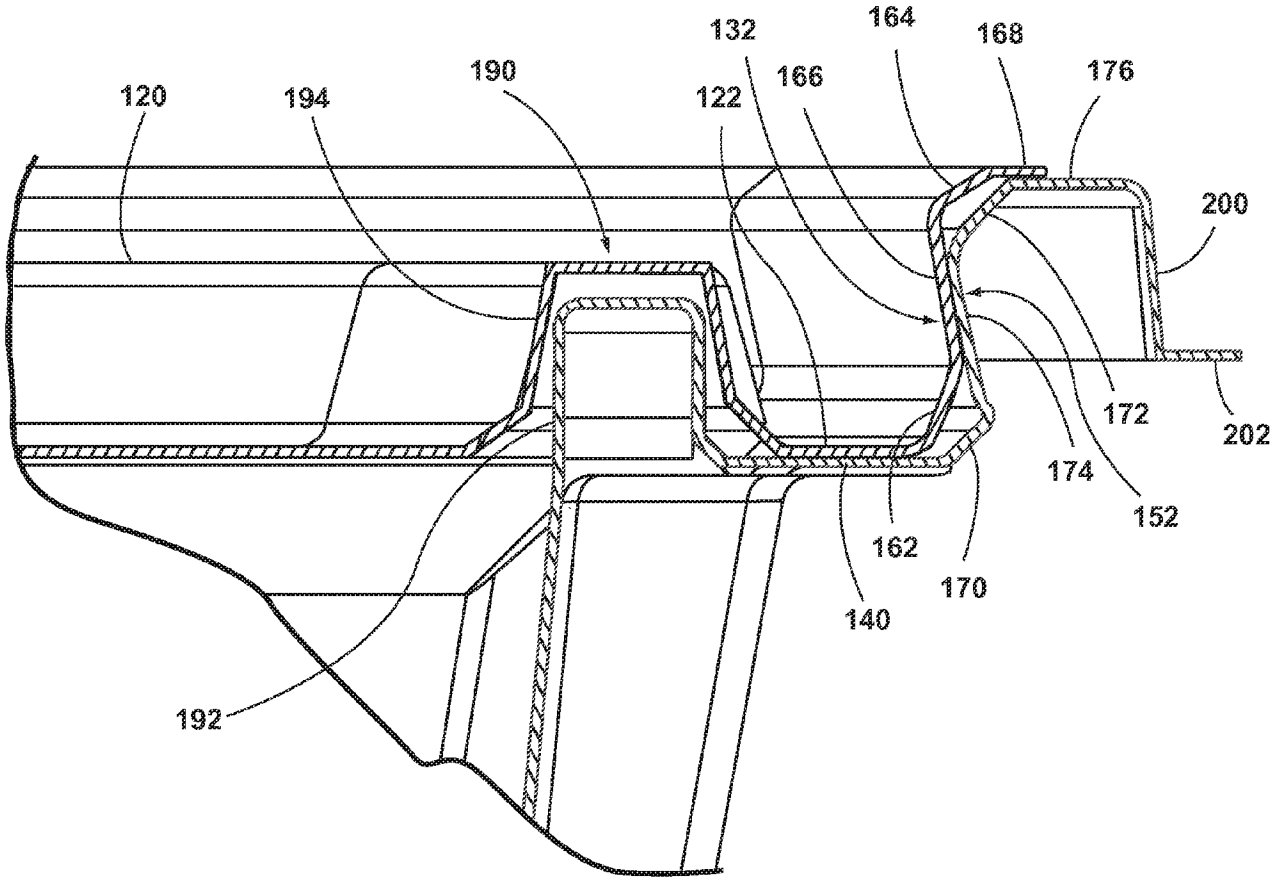
FIG. 11 is a partial cross-section of the container of FIG. 8 taken along the line 11-11.

As can best be seen in FIG. 11, where the cover 112 and tray 114 are not connected by the hinge 116, along the rear sides 126, 146 and lateral sides 128, 130 and 148, 150 of the cover 112 and tray 114, respectively, the peripheral cover lip 168 does not extend outwardly beyond the peripheral tray lip 176. The peripheral cover lip 168 abuts the peripheral tray lip 176 and extends just beyond a junction between the peripheral tray lip 176 and the second outwardly angled tray leg 172. The angle of the second outwardly angled cover leg 164 presses the peripheral cover lip 168 against the peripheral tray lip 176.

The container 110 can be opened in a manner similar to that of the container 10 described above with reference to FIGS. 6 and 7. A consumer can grasp the cover tab 134 and the tray tab 160 and pull the cover tab 134 away from the tray tab 160 to separate the cover 112 from the tray 114. The separation force provided by the consumer when opening the container 110 causes the hinge 116 to tear along one or both of the weakened lines 161 provided in the vertical hinge wall 198. The tearing of the weakened line 161 provides an indication to the consumer that the container 110 has been opened or that an attempt to open the container has been made, thus providing the container 110 with a tamper evident feature.

The length of the peripheral cover lip 168 and the presence of the bar locks 190 make it difficult for a consumer to open the container 110 at any location other than the cover tabs 134. In this manner, the peripheral cover lip 168 and the bar locks 190 provide the container 110 with tamper resistant features in that they prevent a consumer from opening the container 110 in a manner that does not leave evidence that the container 110 has been opened. The circumferential rib 120 provides the container 110 with a tamper resistant feature that prevents unauthorized opening of the container 110. The height and proximity of the circumferential rib 120 relative to the tray rib 152 and the length of the skirt 132 is selected such that the ability of a consumer to grasp the skirt 132 to separate the cover 112 from the tray 114 is prevented. More specifically, the configuration of the circumferential rib 120 prevents the consumer from being able to pinch the peripheral cover lip 168 between his or her thumb and index finger. As used herein, the term pinch is used to mean squeezing the peripheral cover lip 168 and/or other portions of the skirt 132 between the thumb and index finger. The tamper resistance provided by the circumferential rib 120 is related to the amount of the skirt 132 a consumer can pinch such that the consumer can apply enough force to separate the cover 112 from the tray 114. In the container 10 of FIG. 1, the blocking shield 54 renders the peripheral cover lip 68 of the skirt 32 inaccessible to a consumer, in this manner preventing a consumer from opening the container 10 without using the cover tab 34. In the container 110 having the circumferential rib 120 without a blocking shield, the peripheral cover lip 168 of the skirt 132 is accessible to a consumer; however, it is configured so as to not be pinchable by a consumer. It has been found that a configuration of the circumferential rib 120 and rib 152 in which a consumer can only pinch approximately 0.125 inches or less of the skirt 132 prevents the consumer from pinching enough of the skirt 132 such that enough force can be applied to overcome the peripheral seal and separate the cover 112 from the tray 114 to open the container 110. The configuration of the circumferential rib 120, skirt 132 and rib 152 can be selected in concert with each other to provide the desired tamper resistance while taking into consideration design and manufacturing constraints.

Figure 12:
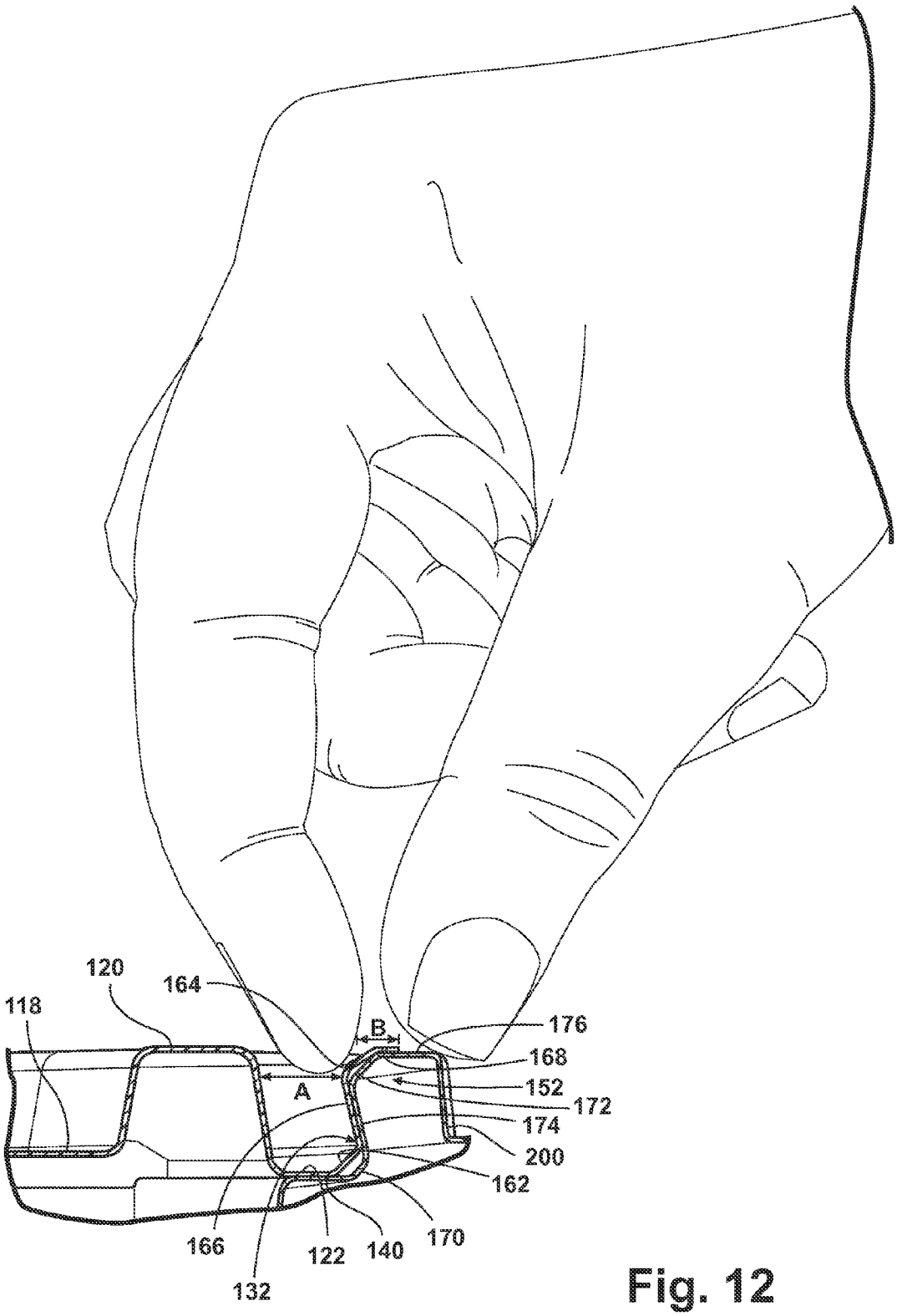
FIG. 12 illustrates a consumer attempting to open the container of FIG. 8 according to the third embodiment of the invention.

FIG. 12 illustrates a consumer's attempt to open the container 110 by pinching the skirt 132 instead of the cover tabs 134. FIG. 12 is not necessarily to scale and is meant for illustrative purposes only. The amount of the skirt 132 that a consumer can pinch depends on both the height and proximity of the circumferential rib 120 relative to the rib 152. In the exemplary embodiment illustrated in FIG. 12, a gap A between the circumferential rib 120 and the rib 152 is smaller than the average width of an adult human index finger and the height of the circumferential rib 120 is approximately equal to that of the rib 152. This limits the depth to which a consumer can insert his or her finger into the gap A in an attempt to pinch the skirt 132, which prevents the consumer from pinching enough of the skirt 132 to separate the tray 112 and the container 114.

In the exemplary embodiment illustrated in FIG. 12, the gap A between the circumferential rib 120 and the rib 152 is approximately 0.177 inches and the height of the circumferential rib 120 is approximately the same as that of the rib 152. The width of the gap A is a function of the width of the peripheral cover flange 122 and the configuration of the first and second outwardly angled cover legs 162 and 164 and the inwardly angled cover leg 166. Assuming the width of an adult human index finger between the nail and fingerprint region of the finger is approximately 0.350 inches, the consumer will only be able to insert a portion of his or her index finger into the gap A, limiting the amount of the skirt 132 the consumer can manipulate in an attempt to open the container 110 to approximately 0.105 inches. This is not enough to allow the consumer to pinch the skirt 132 such that enough force can be applied to overcome the peripheral seal and therefore the consumer will not be able to separate the cover 112 from the tray 114 to open the container 110.

The length of the skirt 132 also contributes to whether or not a consumer is capable of pinching the skirt 132 in an attempt to open the container 110. For example, in the exemplary embodiment of FIG. 12, the length of the peripheral cover lip 168 of the skirt 132, indicated as the length B, is approximately 0.060 inches. This corresponds to the minimum trim flange allowed for the machine form-to-trim misalignment tolerances. However, depending on the specific machine used, the length of the peripheral cover lip 168 could be made shorter or longer. The shorter the peripheral cover lip 168 the harder it will be for a consumer to pinch more than 0.125 inches of the skirt 132 and open the container 110, thus increasing the tamper resistance of the container 110.

As the length of the peripheral cover lip 168 of the skirt 312 increases, the configuration of the circumferential rib 120, rib 152 and gap A can be adjusted accordingly to still provide the desired tamper resistance. For example, the gap A between the circumferential rib 120 and the rib 152 can be made smaller such that the amount of the skirt 132 a consumer can pinch remains less than about 0.125 inches. The smaller the gap A between the circumferential rib 120 relative to the rib 152, the greater the tamper resistance, however, tooling tolerances may limit how close the circumferential rib 120 can be formed to the rib 152.

The height of the circumferential rib 120 relative to the rib 152 can also be increased to minimize the amount of the skirt 132 that a consumer can pinch. Raising the height of the circumferential rib 120 relative to the rib 152 increases the tamper resistance of the container; however this may interfere with the ability to stack the containers and the aesthetic appearance of the container.

In addition to the tamper resistance provided by the circumferential rib 120, the bar locks 190 also contribute to preventing unauthorized opening of the container 110. To open the container 110 without using the cover tabs 134, a consumer would have to deflect the cover 112 inward towards the center of the container 110 in order to pry the peripheral cover lip 168 upwards such that the peripheral cover lip 168 can be pinched and pulled to separate the cover 112 from the tray 114. The presence of the bar locks 190 increases the force required to deflect the cover 112 inward, thus decreasing the possibility that the peripheral cover lip 168 can be pinched and pried away from the cover.

As illustrated in FIGS. 8 and 9, the bar locks 190 can be located near a midpoint of the sidewalls 138, as the midpoint typically corresponds to the areas of the container 110 which are the easiest to deflect inwards, although it is within the scope of the invention for the bar locks 190 to be positioned at any location about the periphery of the container 110.

In addition, the size of the peripheral cover lip 168 and the spacing of the circumferential rib 120 and inwardly angled cover leg 166 limit the ability of a consumer to open the container 110 without using the cover tabs 134. The size of the peripheral cover lip 168 makes it difficult for a consumer to get a firm enough grasp such that the force of the perimeter interference seal and the bar lock seal can be overcome to open the container 110. The location of the circumferential rib 120 near the inwardly angled cover leg 166 limits the space available for a consumer to attempt to grasp the peripheral cover lip 168. In this manner, the circumferential rib 120 provides the container 110 with a type of blocking shield to prevent a consumer from accessing the cover lip 168 by pinching the cover lip 168 between his or her thumb and index finger in an attempt to open the container 110 without the use of the cover tabs 134.

As described above with reference to container 10, the hinge 116 does not extend along the full length of the front sides 124 and 144 of the cover 112 and tray 114, respectively, but rather extends only along a portion of the front sides 124, 144 between the cover tabs 134. The tray tabs 160 are spaced laterally from the hinge 116 and cover tabs 134 on the skirt flange 202. According to the embodiment illustrated in FIGS. 8-11, the tray tabs 160 are also vertically spaced from the cover tabs 134 by the hinge wall 198. The length of the hinge 116 and the lateral and vertical spacing of the tray tabs 160 from the cover tabs 134 provides room underneath the cover tabs 134 for a consumer to pinch the cover tab 134, thus making it easier for the consumer to adequately pinch the cover tab 134 and provide enough force to separate the cover 112 and tray 114.

Figure 13:
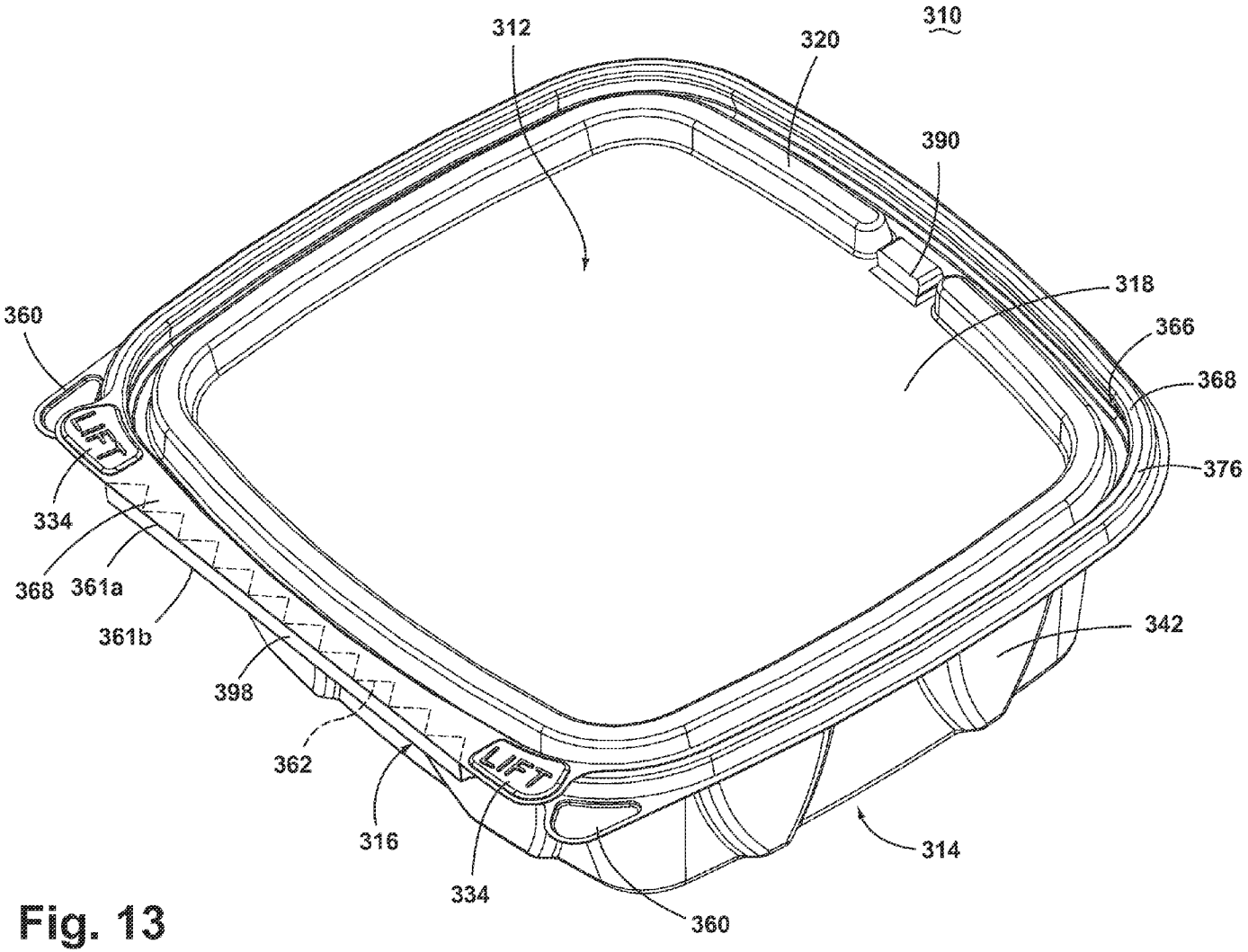
FIG. 13 is a perspective view of a container having a cover hingedly mounted to a tray in a closed position according to a fourth embodiment of the invention.
Figure 14:
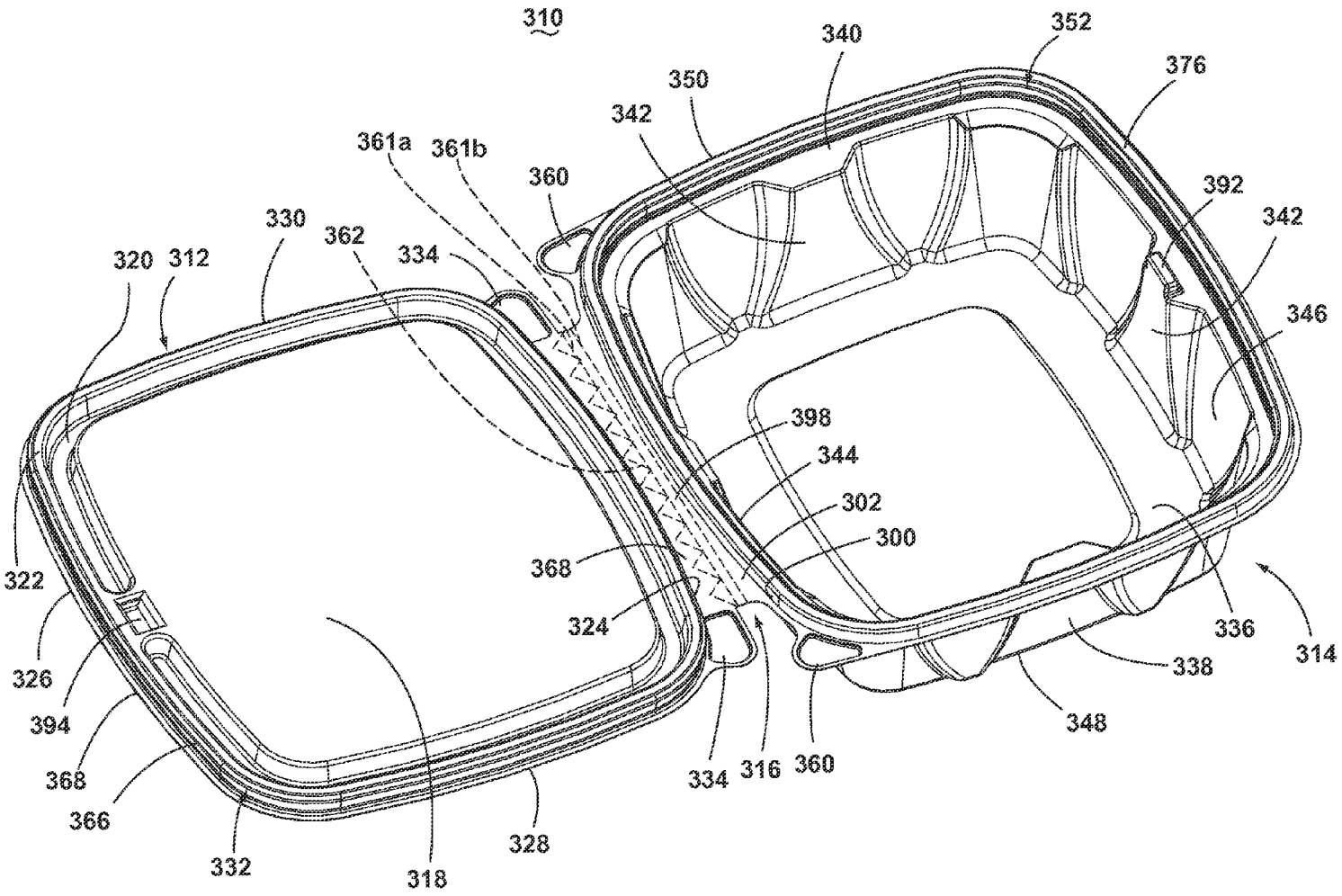
FIG. 14 is a perspective view of a container having a cover hingedly mounted to a tray in an open position according to the fourth embodiment of the invention.

FIGS. 13 and 14 illustrate another embodiment of the invention comprising a container 310, which is similar to the container 110 except for the container 310 has a single bar lock 390 instead of the three bar locks 190 of the container 110. Therefore, elements in the container 310 similar to those of the container 110 will be numbered with the prefix 300.

The cover 312 includes the top 318 from which extends the blocking wall 320. The blocking wall 320 extends around the perimeter of the top 318 except for where the blocking wall 320 is interrupted by a bar lock 390. A male portion 392 of the bar lock 390 can be formed in an extension of the peripheral tray flange 340 which projects inward toward a center of the tray 314 and is connected with an upper portion of a corresponding inwardly projecting support panel 342. The cover 312 is provided with a female portion 394 of the bar lock 390 corresponding to the male portion 392. It is also within the scope of the invention for the location of the male and female portions 392, 394 on the tray 314 and cover 312 to be reversed. As illustrated in FIG. 14, the male portion 392 can be formed in the peripheral tray flange 340 corresponding to a generally centrally located support panel 342 formed in the rear side 346 of the tray 314.

Along the front sides 324, 344 the cover 312 and tray 314 are connected by the hinge 316. The hinge 316 comprises a vertical hinge wall 398 coupled at an upper portion thereof with the peripheral cover lip 368 and at a lower portion thereof by a downwardly extending skirt 300 and an outwardly extending skirt flange 302. The hinge wall 398 can be connected with both the cover 312 and the tray 314 at upper and lower portions thereof by a pair of weakened lines 361*a* and 361*b*, respectively, that can be in the form of coined or fold lines. The cover 312 can be connected with the weakened line 361*a* by a non-linear perforation line 362 that tears when the cover 312 is removed from the tray 314. While the non-linear perforation line 362 is illustrated as a wavy or squiggly line, the non-linear perforation line can have any curved, jagged, undulating, rippled, scalloped or zig-zag shape, for example, such that when torn, the perforation line 362 has a non-linear appearance when the cover 312 is viewed from above the plane defined by the top 318. The non-linear appearance makes it more readily visible to the consumer, which aids the consumer in determining tampering.

Referring back to FIGS. 13 and 14, the cover tabs 334 can be formed in the skirt 332 adjacent the hinge 316. The tray tabs 360 can be formed in the skirt flange 302, laterally spaced from both the hinge 316 and the cover tabs 334 and vertically spaced from the cover tabs 334. In the closed position illustrated in FIG. 13, neither the cover tabs 334 nor the tray tabs 360 extend beyond the hinge line.

The container 310 can be opened in the same manner as described above for the container 110. The configuration of the blocking wall 320, skirt 332 and rib 352 prevent a consumer from pinching enough of the skirt 332 to overcome the peripheral seal and bar lock 390 to separate the cover 312 from the tray 314, thus providing the container 310 with a tamper resistant feature in the same manner as that described above with reference to the container 110. In addition, the presence of the bar lock 390 increases the force required to deflect the cover 312 inward, thus decreasing the possibility that the skirt 332 can be pried away from the tray 314. The non-symmetrical perforation line 362 provides enhanced visibility of the torn hinge 316 when the container 310 is opened compared to a straight perforation line to indicate to a consumer that the container 310 has been opened.

While the container 310 has been described in the context of a pair of coined lines 361*a, b* and a non-symmetrical perforation line 362, it is within the scope of the invention for container 310 to include any of the features of any of the hinges described herein.

Figure 15:
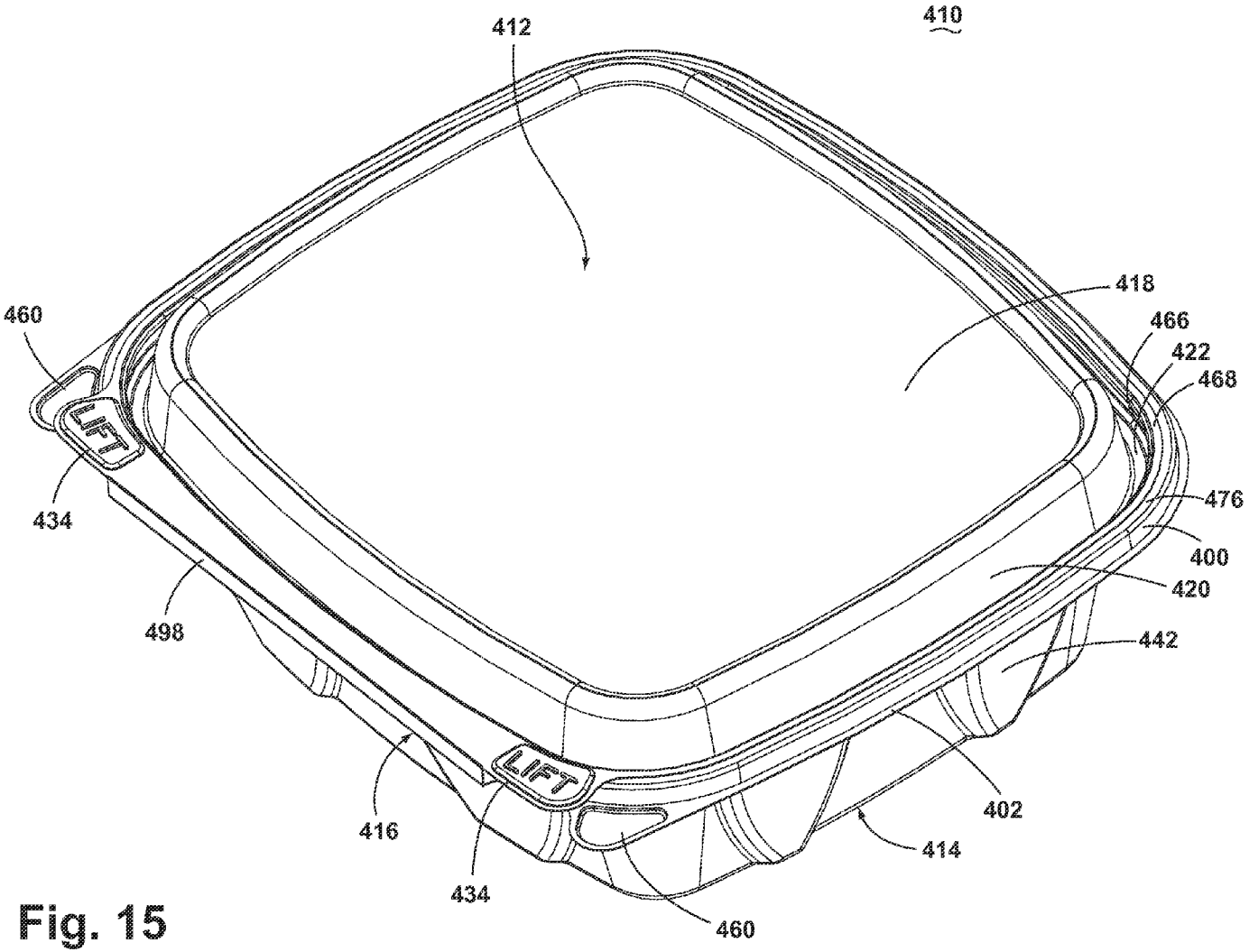
FIG. 15 is a perspective view of a container having a cover hingedly mounted to a tray in a closed position according to a fifth embodiment of the invention.
Figure 16:
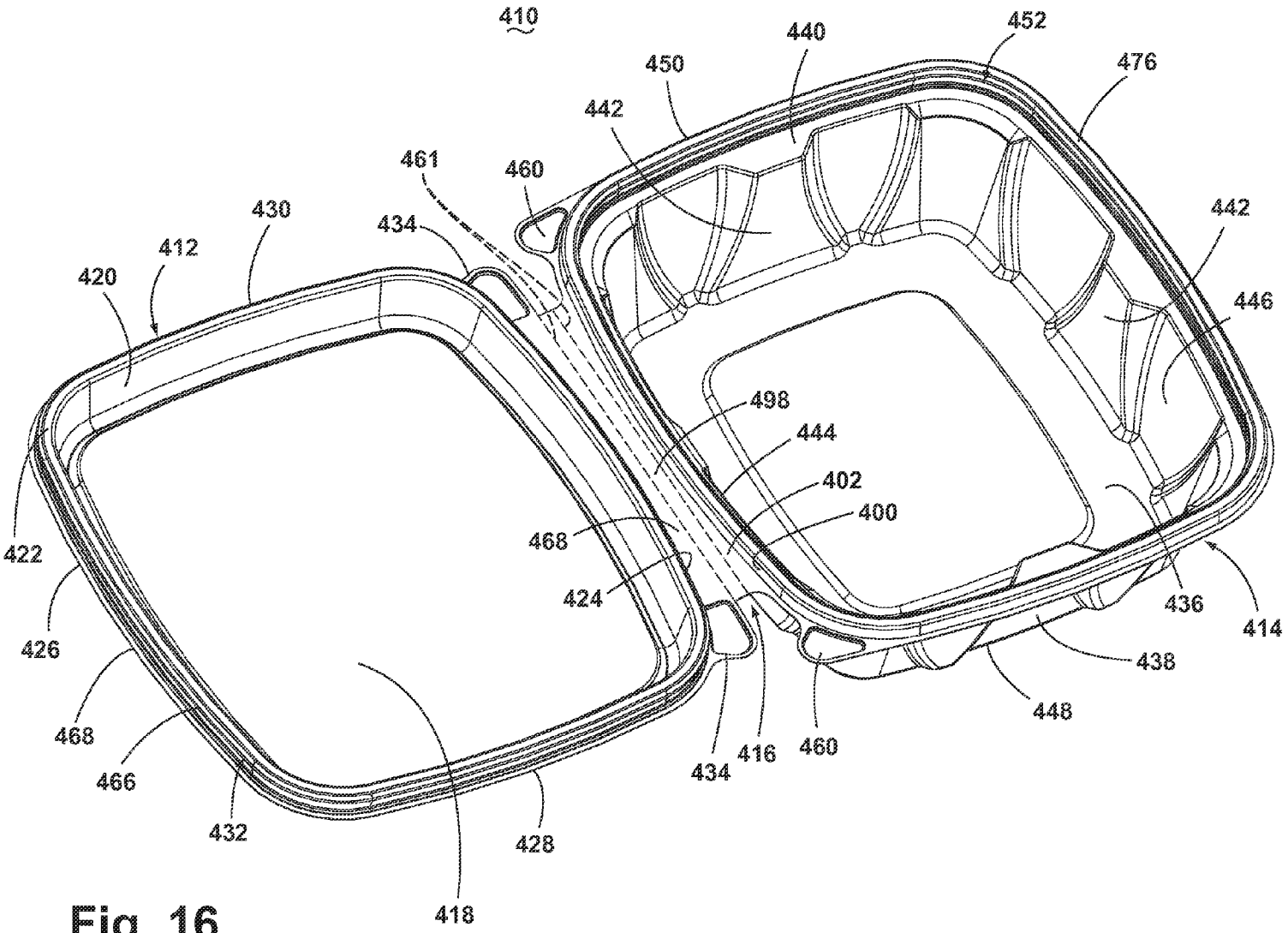
FIG. 16 is a perspective view of a container having a cover hingedly mounted to a tray in an open position according to the fifth embodiment of the invention.

FIGS. 15 and 16 illustrate another embodiment of the invention comprising a container 410, which is similar to the container 110 except for the shape of the lid 412 and the blocking wall and the absence of the bar locks. Therefore, elements in the container 410 similar to those of the container 110 will be numbered with the prefix 400.

Referring now to FIGS. 15 and 16, the cover 412 includes the top 418 from which depends a cover sidewall 420. The cover sidewall 420 extends from the top 418 to the peripheral cover flange 422. The height of the cover sidewall 420 can be selected to provide the container 410 with a cover 412 having a dome shape of any desired height. The cover tabs 434 can be formed in the skirt 432 adjacent the hinge 416. The tray tabs 460 can be formed in the skirt flange 402, laterally spaced from both the hinge 416 and the cover tabs 434. In the closed position illustrated in FIG. 15, neither the cover tabs 434 nor the tray tabs 460 extend beyond the hinge line.

Along the front sides 424, 444 the cover 412 and tray 414 are connected by the hinge 416. The hinge 416 comprises a vertical hinge wall 498 coupled at an upper portion thereof with peripheral cover lip 468 of the skirt 132 by a weakened line 461. The peripheral tray lip 476 is connected with the vertical hinge wall 498 at a lower portion thereof by a downwardly extending skirt 400 and an outwardly extending skirt flange 402. The hinge wall 498 can be connected with both the cover 412 and the tray 414 at upper and lower portions thereof by a pair of weakened lines 461. In one example, the pair of weakened lines 461 can be in the form of perforation lines. In another example, the hinge wall 498 can be connected with one of the cover 412 and tray 414 by a perforation line and the other of the cover 412 and tray 414 by a coin line. In yet another example, at least one of the pair of weakened lines 461 can be formed from a series of alternating rounded crests and troughs of narrowed thickness.

The container 410 can be opened in a manner similar to that described above for container 110. The cover sidewall 420 provides the container 410 with tamper resistance in a manner similar to that described above for the circumferential rib 120 and 320 of the containers 110 and 310, respectively, to prevent a consumer from pinching the skirt 420 in an attempt to open the container 410 without the use of the cover tabs 434. The height and proximity of the sidewall 420 to the rib 452 prevents the consumer from pinching enough of the skirt 132 to apply enough force to overcome the peripheral seal to separate the cover 412 from the tray 414.

The embodiments of the invention described herein provide a container which is tamper resistant and also provides evidence to a consumer when tampering or attempts at tampering have occurred. The spacing of the cover tabs adjacent the hinge but spaced from the tray tabs facilitates easy access to the contents of the container. The separation of the cover and the tray along the hinge and the separation of the cover and the tray from one another can be achieved in a single step by pulling the cover tab. Attempts to open the container without using the cover tab and without damaging the container itself are resisted by features such as the blocking shield, the configuration of the blocking wall, cover skirt and tray rib, and the bar locks. In addition, once the container has been opened, the cover can be replaced and re-sealed with the tray while still providing visual evidence to a consumer that the container has already been opened.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A container having tamper evident and tamper resistant features comprising:

a tray comprising a bottom wall and a peripheral side wall extending upwardly from the bottom wall and defining an open top;

a cover;

a hinge extending from the cover and tray to a radially outermost portion and having a first portion extending from a first side of the cover and a second portion extending from a first side of the tray, the hinge defining a hinge axis about which the tray and cover relatively rotate between a closed position and an opened position;

a first tab provided on one of the cover or the tray and entirely located radially interiorly of the radially outermost portion of the hinge; and a second tab provided on the other of the cover or the tray and entirely located radially interiorly of the radially outermost portion of the hinge;

wherein, when the cover is in the closed position, the first and second tabs are spaced relative to each other such that a user may grasp the first tab with one hand and the second tab with another hand and relatively pull the first tab and the second tab away from each other to tear the hinge and separate the cover from the tray, and wherein the first and second tab are present prior to tearing the hinge.

2. The container of claim 1 wherein one of the cover or the tray comprises a peripheral lip and the other of the cover or the tray comprises a blocking shield preventing direct access to the peripheral lip when the container is in the closed position.

3. The container of claim 1 wherein one of the cover or the tray comprises a peripheral lip and the other of the cover or the tray comprises a tamper resistant element preventing pinching of the peripheral lip when the container is in the closed position.

4. The container of claim 3 wherein the tamper resistant element comprises a blocking wall extending upwardly from a top wall of the cover.

5. The container of claim 4 wherein one of the cover or the tray comprises a rib, and the peripheral lip lies on top of the rib when the cover is mounted to the tray to close the open top of the tray, and wherein a length of the peripheral lip in combination with the blocking wall render the peripheral lip not pinchable.

6. The container of claim 1 further comprising at least one bar lock securing together the cover and the tray.

7. The container of claim 1 wherein the first and second tabs at least partially overlap vertically.

8. The container of claim 1 wherein the first and second tabs are laterally offset from the hinge.

9. The container of claim 1 further comprising a second set of first and second tabs located on an opposite end of the hinge than the first set of first and second tabs.

10. The container of claim 1 wherein the first and second tabs are vertically offset from one another.

11. The container of claim 1 wherein the hinge comprises at least one line of weakness configured to tear when the container is opened.

12. The container of claim 1 wherein the hinge comprises first and second lines of weakness with at least one of the first or second lines of weakness configured to tear when the container is opened.

13. The container of claim 12 wherein the at least one of the first or second lines of weakness configured to tear when the container is opened is linear.

14. The container of claim 12 wherein the at least one of the first or second lines of weakness configured to tear when the container is opened is non-linear.

15. The container of claim 1 wherein the tray comprises a tray seal structure and the cover comprises a cover seal structure and the tray seal structure and the cover seal structure form a peripheral seal when the cover closes the open top of the tray.

16. The container of claim 15 wherein separating the cover from the tray comprises unsealing the peripheral seal.

* * * * *